United States Patent [19]

Mykleby

[11] Patent Number: 4,622,693

[45] Date of Patent: Nov. 11, 1986

[54] COLLAPSIBLE BAG AND LINER COMBINATION

[75] Inventor: Laurie G. Mykleby, Palos Park, Ill.

[73] Assignee: CVP Systems, Inc., Downers Grove, Ill.

[21] Appl. No.: 725,926

[22] Filed: Apr. 22, 1985

[51] Int. Cl.[4] ..... B65D 33/02

[52] U.S. Cl. ..... 383/119; 206/45.33; 220/449; 220/462

[58] Field of Search ..... 220/461, 462, 463, 418, 220/416, 449; 206/45.31, 45.33; 229/41 R; 383/119

[56] References Cited

U.S. PATENT DOCUMENTS

| | | | |
|---|---|---|---|
| 2,223,754 | 12/1940 | Waters | 220/416 |
| 2,479,456 | 8/1949 | Arthur | 220/418 |
| 2,493,337 | 1/1950 | Buttery | 220/416 |
| 2,556,321 | 6/1951 | Denton | 220/418 |
| 2,697,546 | 12/1954 | Bergstein | 220/418 |
| 2,766,926 | 10/1956 | Thompson | 383/119 |
| 2,893,877 | 7/1958 | Nickels | 220/449 |
| 3,074,798 | 1/1963 | Palmer | 206/45.33 |
| 3,148,769 | 9/1964 | Bryant | 206/45.33 |
| 3,194,471 | 7/1965 | Murphy | 220/462 |
| 3,233,816 | 2/1966 | Cherrin | 220/462 |
| 3,392,900 | 7/1968 | Vogt | 220/449 |
| 3,679,048 | 7/1972 | Fujio | 206/45.33 |
| 4,064,302 | 12/1977 | Kozlowski et al. | 220/461 |
| 4,284,205 | 8/1981 | Hirata | 220/461 |
| 4,512,463 | 4/1985 | Ward | 220/461 |

FOREIGN PATENT DOCUMENTS

| | | | |
|---|---|---|---|
| 1558181 | 12/1979 | United Kingdom | 220/461 |

*Primary Examiner*—George E. Lowrance
*Assistant Examiner*—Gary E. Elkins
*Attorney, Agent, or Firm*—Thomas W. Speckman

[57] ABSTRACT

A packaging assembly wherein a protective liner is affixed to the interior surface of a flexible bag in a manner such that the packaging assembly folds flat for storage and transport and is readily converted to a substantially rectangular box for loading. The flexible bag extends beyond the top of the liner in a manner such that evacuation and controller atmosphere packaging techniques may be readily applied and the packaging assembly readily sealed. The packaging assembly is especially suited to prevent puncturing of the packaging by either the internal contents or from external sources and provides labor efficient packaging techniques.

22 Claims, 3 Drawing Figures

COLLAPSIBLE BAG AND LINER COMBINATION

BACKGROUND OF THE INVENTION

1. Field of the Invention

This invention relates to a packaging assembly wherein a protective liner is affixed to the interior surface of a flexible bag. The packaging assembly folds flat to provide efficient storage and transport and its unitary construction facilitates simplified assembly and use. The packaging device of this invention is especially suitable for use to provide sealable packaging of sharp or pointed objects, such as ribs or loins, in the food packaging industry.

2. Description of the Prior Art

The food packaging industry is continually striving to develop improved packaging to preserve the freshness of food items. Maintaining freshness is, of course, particularly important for perishable food items such as meat, poultry, fish, produce, dairy products, and specialty items. It is crucial, from a public health standpoint, that food packaging is effective to retain freshness and prevent spoilage of food items.

One common method of packaging food products, particularly meat and produce items, involves placing the portion to be packaged on a shallow tray with upturned edges, enclosing the food and the tray with clear flexible sheet wrapping material and sealing the ends of the sheet wrapping material underneath the tray. This packaging method has several disadvantages. The clear flexible sheet wrapping material is easily punctured by bones, stems or other sharp protrusions from food items. As soon as the packaging is punctured, air, macroscopic and microscopic contamination come into contact with the food item and accelerate spoilage. In addition, any residual matter, particularly fluids, may leak from the package. In general, this method of packaging is messy and inefficient. It does not satisfactorily preserve freshness, nor does it prevent spoilage of food products.

Sophisticated bulk packaging techniques have been developed in an effort to extend the shelf life of meat and poultry products. Vacuum packaging techniques whereby air is removed before the packaging is sealed, have been found to improve the shelf life of meat products and to retard spoilage. Moreover, a controlled, modified atmosphere may be established within the packaging after air has been removed and before the packaging is sealed to provide improved meat and poultry shelf life. It is desirable to seal the products in a flexible, clear plastic or similar material for visual display, but this type of packaging is not suitable for many applications because sharp edges protruding from meat or produce products, such as bones or stems, may puncture the bag, thereby breaking the seal. This problem is increased when packaging large, heavy products, such as whole loins, slabs of ribs, and the like. It is necessary either to use a very thick and puncture-resistant wrapping material, or to place a barrier or shield around the product before it is enclosed by flexible, sealable material. Each of these alternatives is costly, in terms of both materials and labor.

Packaging techniques presently utilized in conjunction with vacuum-type or modified atmosphere packaging systems are inefficient and labor intensiye. Typically, a coated paperboard shield box or tray must be assembled, the shield box must be placed in a flexible, sealable bag, product may then be loaded into the shield box and the packaging is processed, sealed, and prepared for shipment by being placed in a corrugated container suitable for shipping. The inner box or shield box must have sufficient strength and rigidity to prevent sharp objects from protruding through the walls or bottom. It must be sufficiently stiff so that it does not collapse as it is being loaded with product. It is desirable that the shield box is foldable for storage and transport, but a foldable box is likely to collapse during product loading, or to separate from the bag allowing product to fall between the exterior of the shield box and the interior of the bag. Excess portions of the bag may become bunched underneath the shield box, making subsequent vacuum application and sealing very difficult, and increasing the risk of puncturing the bag.

SUMMARY OF THE INVENTION

The present invention overcomes many of the deficiencies of the prior art packaging assemblies and provides a simple, cost efficient and very effective single unit packaging assembly. The packaging assembly of this invention is especially suitable for packaging products having irregular edges or sharp protrusions which might project through a plastic sheet wrapping.

The present invention provides a single unit packaging assembly comprising a protective liner affixed to the interior surface of a flexible bag, preferably a sealable bag. The packaging assembly folds flat for simple and economical storage and transport and may be assembled with very little effort by simply opening the bag at the open top portion. As the bag is opened from the top, the interior liner is arranged to form a three-dimensional box-shaped receptacle. The interior liner is jointed at strategic locations so that the packaging assembly may be stored flat, and yet forms a generally rectangular box-shaped receptacle when opened.

The protective liner when opened, comprises two side walls having substantially the same dimensions arranged parallel to each other, a bottom wall which extends continuously between the two side walls, and two end walls forming a box closed on five sides and open at the top. Joints are provided so that the liner may be folded flat, may open to form a box-shaped structure, and is quickly and conveniently converted, from one form to the other. The term "joint" as referred to in this specification and the appended claims, means an intersection of two walls or wall portions which are pivotable with respect to one another along the longitudinal axis of the intersection, including the intersection of two separated walls or wall portions defined by an open space, a fold, a score, a perforation, a hinge, or any other means, whereby wall portions of an integral wall or adjacent walls are pivotable with respect to each other. A joint is provided along a central portion of the length of the bottom wall extending from the intersection of the bottom wall with each end wall. A joint is also provided along a central portion of each end wall and extending from the bottom wall to the top of the box when the liner is in the open, loading position, at each intersection of an end wall with a side wall, at each intersection of an end wall with the bottom wall, and at each intersection of a side wall with the bottom wall. The liner may comprise any rigid or semi-rigid material which is puncture-resistant to sharp objects. The liner preferably comprises a lightweight plastic coated paperboard. A protective liner constructed in this manner and used in the packaging assembly of this invention requires less material than a conventional foldable box.

Additional strength may be obtained by providing doubled liner material in any critical locations.

The flexible bag may comprise any of a number of suitable sheet materials which are well known to the art, such as paper products and preferably sheet heat sealable polymeric materials such as polyethylene or polypropylene by themselves or co-extrusions or laminated to materials such as nylon or polyester. The bag preferably comprises continuous extruded tubular sheet material which is sealed along one end to form the bottom of the bag. Alternatively, the bag may comprise two separate sheets of flexible material which have been sealed along three sides to form a sealed bottom and two sealed sides, or a continuous sheet folded over itself and sealed along two side seams.

The width dimensions of the bag are slightly larger than the flat folded dimensions of the protective liner, and the open top of the bag extends well beyond the top opening of the protective liner. The bag must be slightly wider than the protective liner to provide that the open portion of the bag extending beyond the top opening of the liner is larger than the liner top opening so that the flexible bag materials may be easily folded down outside the top edges of the liner. It is desirable for the open end of the bag to extend beyond the top opening of the protective liner to provide sufficient packaging material for convenient evacuation of air or provision of modified atmosphere and for ease of sealing. If the exterior bag were coextensive with the liner, it would be very difficult to fold the top of the bag over the outside walls of the liner for product packing purposes.

The protective liner is positioned in the bottom of the bag so that the joint in the central portion of the bottom wall rests adjacent the bottom of the bag. The liner is centrally positioned within the bag so that the side excess portions of the bag are evenly distributed with respect to the liner. The liner is affixed to the flexible bag, preferably along an upper portion of the liner side and end walls. Attachment of the liner to the bag along an upper portion of the liner side walls and end walls provides support for the liner walls when the packaging assembly is in the open, packing position, and prevents product from falling between the bag and the liner during packing. Additional points of attachment may be provided to more securely affix the liner to the flexible bag. Attachment of the liner to the bag also aids in converting the liner bag assembly from a flat folded condition to its box shape for loading product and aids in folding the open top portion of the bag over the outside of the liner to form a loading opening. It is preferred that the liner is affixed to the bag additionally along a lower portion of the liner side and end walls to provide further support for the liner assembled in the packing position and to facilitate simple assembly of the packaging device. The sealing lines preferably continue to seal the inside faces of the flexible bag beyond the liner extending to the edges of the bag.

DESCRIPTION OF THE PREFERRED EMBODIMENTS

Figure 2:
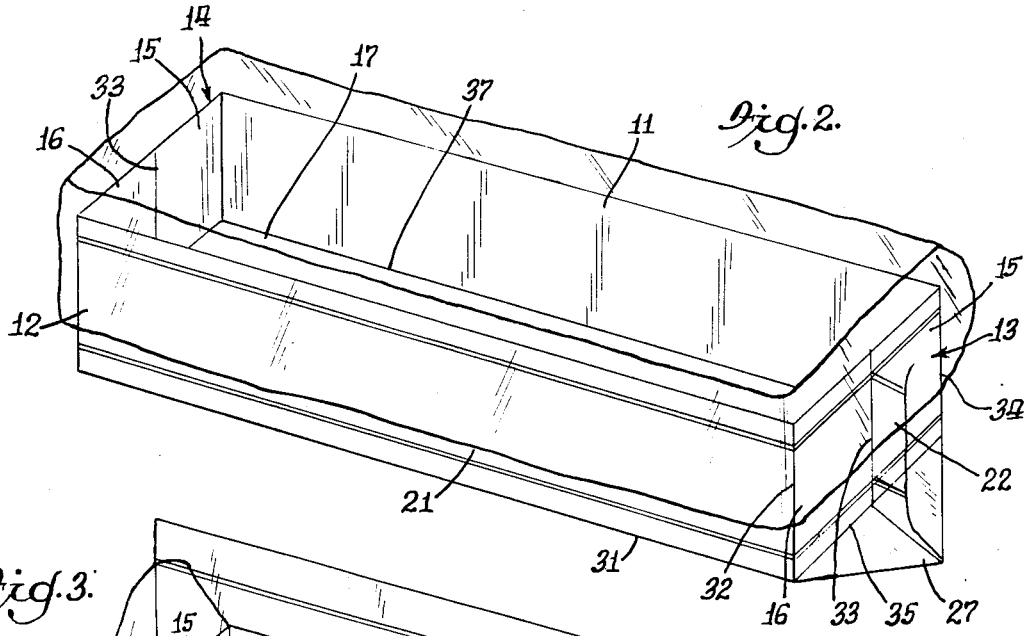
FIG. 2 shows a perspective view of the packaging assembly shown in FIG. 1 in the product loading position.

As shown in the figures, the packaging assembly of the present invention comprises a flexible bag 20 and an interior liner 10. Liner 10 comprises two side walls, 11 and 12, having the same dimensions, a bottom wall 17, and two end walls 13 and 14, having the same dimensions. Side walls 11, 12, and end walls 13, 14, respectively, are substantially parallel to each other and at substantially right angles to bottom wall 17 when the packaging assembly is in the open, loading position forming a generally rectangular, open top box as shown in FIG. 2. It is understood that liner 10 is preferably generally rectangular, but widely different dimensions may be preferred for different packaging applications. For example, liner 10 may comprise a shallow tray or a deep box, and it may be long and narrow, or it may be square. Likewise, the packaging assembly of this invention may be constructed in any size appropriate for the desired product from individual servings to packaging of bulk products. It is especially preferred that the liner box in loading position be about 20 to about 40 inches long by about 8 to about 20 inches wide by about 5 to about 20 inches high, to accommodate bulk shipments, such as meat and fruits or vegetables.

Figure 1:
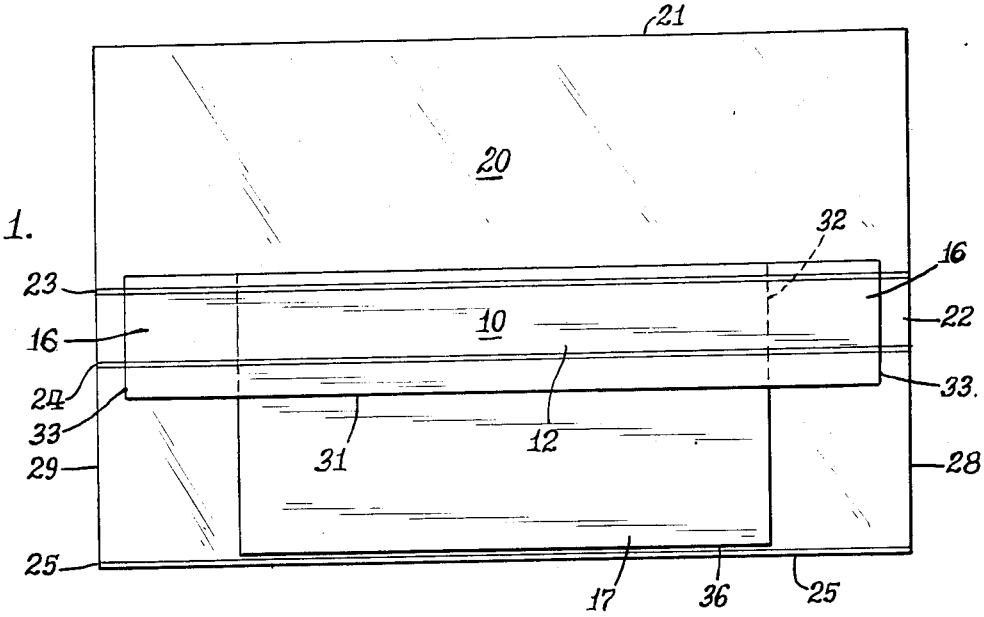
FIG. 1 shows a plan view of the packaging assembly of this invention folded flat.

Joints are provided in the liner to enable the packaging assembly to be folded flat for storage, and to be easily converted to the open, loading position. As described above, the term "joint" includes the intersection of two wall portions defined by a space, a fold, a score, a perforation, a hinge, or any other means whereby two wall portions or walls are pivotable with respect to each other. As shown in FIGS. 1 and 2, joint 33 is in the central portion of end walls 13, 14, forming end portions 15 and 16. End portions 15, 16 may preferably be integral with and form an extension of the adjacent side wall 11, 12, respectively. Joints 32 and 34 are provided at the intersection of each end portion with the adjacent side wall. The bottom edge of the end portions is adjacent the end of bottom wall 17 in the assembled condition as shown in FIG. 2 and forms intersection 35. Bottom wall 17 may preferably be integral with one or both of the side walls, and joints 31 and 37 are provided at the intersections of side walls 12, 11, respectively, with bottom wall 17 for convenient conversion of the packaging assembly in its folded, flat position to the open, loading position. Joint 36 is provided along the central portion of bottom wall 17 for its entire length, so that bottom wall 17 may be folded along joint 36 for flat storage.

Protective liner 10 may comprise any material which is rigid or semi-rigid and resistant to puncture. The protective liner preferably comprises a lightweight paperboard or plastic coated paperboard, but other materials which are well known to the art are suitable. A lighter weight liner material may be used with the packaging assembly of this invention than is used with prior art packaging because sealing the liner to the outer bag provides additional structural support for the liner, especially in its open, loading position. Also, with the liner fastened to the bag, less material is used for the liner than a conventional box since structural overlap or adhering flaps are not necessary.

In one embodiment of protective liner 10 especially preferred for use with the packaging assembly of this invention, protective liner 10 comprises a single, unitary paperboard sheet. End portions 16 are formed as a unitary extension of side wall 12 and folded along joint 32. Likewise, end portions 15 are formed as a unitary extension of side wall 11 and folded along joint 34. Side walls 11, 12 are formed as a unitary extension of bottom wall 17 and folded along joints 37, 31, respectively. Joint 33 formed at the intersection of end portions 15, 16 and joint 35 formed at the intersection of end walls 13, 14 with bottom wall 17 are open because they are formed at the intersection of two non-continuous walls or wall portions. FIG. 1 shows this embodiment of protective liner 10, folded along joint 36 at the mid-line of bottom wall 17. Protective liner 10 thus requires less material than a foldable box of the same dimensions would require.

Outer bag 20 comprises a flexible material which is heavy enough to resist puncture by liner 10 and sturdy enough to withstand vacuum packaging operations. Outer bag 20 is preferably clear for visual observation of the contents, but may comprise a translucent or opaque material. Suitable materials are well known to the art as disclosed above. Outer bag 20 preferably comprises a single, continuous sheet tube formed by extrusion and sealed at bottom bag seal 25 to form an open ended bag. The bag is folded flat along side fold lines 28 and 29. Alternatively, outer bag 20 may comprise two separate sheets sealed along the entire length of their bottom and side edges, or a single sheet folded over itself and sealed along two side edges. Bag 20 extends any desired distance dependent upon the contents and method of packaging beyond the top of protective liner 10. The bag is open along its top edge 21 for loading and treating.

Protective liner 10 may be affixed to the interior surface of bag 20 along an upper portion of its sides and ends along upper attachment seal 23. Any suitable means for affixing protective liner 10 to bag 20 may be used, such as adhesive or sealing means. Preferred is heat sealing of a heat sealable bag to a plastic coated liner by methods well known to the art. The protective liner may be affixed to the outer bag by means of a continuous seal, or by means of a series of skip seals, as known to the art. It is preferred that the seal affixing the bag to the upper portion of the liner sides and end be continuous to prevent materials from entering the space between the liner and the bag. Additional points of attachment may be provided to more securely affix liner 10 to outer bag 20. It is especially preferred that an additional point of attachment is provided along a lower portion of liner sides and ends at lower package seal 24 to provide additional structural stability to the packaging assembly. It is also preferred that outer bag 20 be affixed to liner 10 in the region of liner bottom wall 17 adjacent the bottom of bag 20. These additional attachments between liner 10 and bag 20 improve ease of folding the packaging assembly flat and opening the packaging assembly for product loading and handling.

Figure 3:
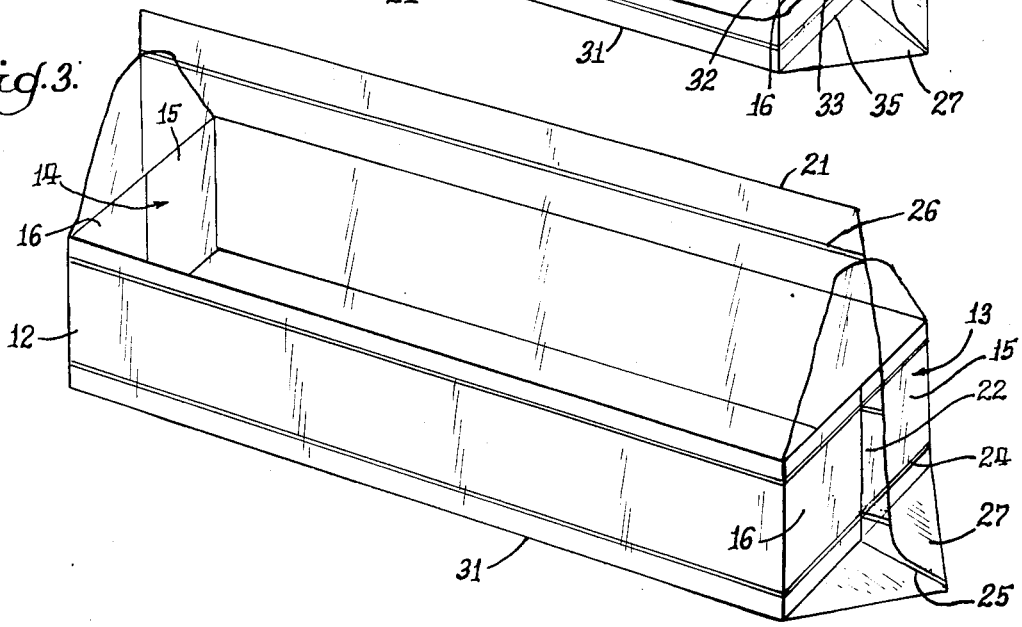
FIG. 3 shows a perspective view of the packaging assembly shown in FIG. 1 in position for product treatment and package sealing.

As shown in the figures, outer bag 20 is slightly wider than protective liner 10 in the folded flat position. Liner 10 is centrally positioned within bag 20 so that bag extensions 22 are formed adjoining the central portion of each end wall. Attachment seals 23 and 24 are preferably extended to seal bag extensions 22 together, as shown in FIGS. 1 and 3, but this is not required. It is preferred that upper attachment seal 23 extend to the edges of bag 20 to prevent foreign materials from entering between liner 10 and bag 20. Bag extensions 22 preferably protrude from each end wall a distance corresponding to about 10 percent to about 50 percent, preferably about 20 to about 30 percent, the width of end wall 13 or 14 to provide sufficient larger upper portion of the bag, as compared to the liner, so that the upper portion of the bag may be readily folded down around the outside of the packaging assembly, as shown in FIG. 2. Bag corner portions 27 extend from end walls 13, 14 and may be folded against the packaging assembly when it is loaded into a corrugated or other container for shipping.

After product has been loaded into the box-type liner, the top open edge 21 of bag 20 may be extended as shown in FIG. 3 and may be subjected to desired additional operations, such as vacuum packing or modified atmosphere packing, prior to closing the packaging assembly. The open end of bag 20 may be sealed by any suitable means, such as by heat, as shown by top bag seal 26.

Alternatively, after the product has been loaded into the box-type liner, a separate rigid or semi-rigid cover may be inserted in the top open edge 21 of bag 20 to cover the packed products. A top may also extend upwardly from liner sides 11 and 12 in a jointed fashion and be folded into a closed position. The upper portion of the bag may be folded over and tied or sealed in any fashion desired or the folded over bag containing the product filled box-type liner may be readily packaged into a corrugated or other container for shipment.

The packaging assembly of this invention is especially well suited to vacuum packing or modified atmosphere packing of food products having sharp protruding edges, such as wholesale meat cuts, including particularly, full loins, ribs and the like, as well as nuts, fruits, vegetables, and other foodstuffs. The packaging assembly of this invention may also be advantageously used for evacuated or modified atmosphere packaging of fragile materials, such as fruits and vegetables to prevent damaging by objects entering the package from the exterior.

The packaging assembly of this invention permits use of lighter materials than used in former packaging of similar goods and provides considerable economies in time afforded due to its customized nature and ease of use, particularly in bulk packaging when using modified atmosphere techniques.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A packaging assembly comprising:

a protective liner constructed of rigid or semi-rigid, protrusion resistant material having two side walls, a bottom wall, and two end walls, each said end wall comprising two end portions, said protective liner provided with joints along a central, longitudinal portion of said bottom wall, at an intersection of each said side wall with each said end wall, at an intersection of each said side wall with said bottom wall, and at an intersection of said end portions forming each of said end walls, said liner when folded upon itself along said joints forming a flat form with each said end portion extended outwardly from its adjacent side wall; and an outer bag of flexible sheet material closed except for an open top and being wider than the length of said protective liner side wall plus two adjacent said end wall portions when folded flat, the inner surface of said bag attached to the outer surface of said liner along an upper portion of said side and end walls, said central bottom joint of said protective liner being located adjacent the bottom of said bag whereby said packaging assembly may be folded flat for storage and transport and converted to a substantially rectangular box closed on five sides by said liner providing side, end, and bottom walls when said outer bag is opened, and said open top of said bag extending beyond the top opening of said side and end walls of said liner.

2. A packaging assembly according to claim 1, wherein said side walls have substantially the same dimensions, said end walls have substantially the same dimensions, said side walls are substantially parallel to each other, said end walls are substantially parallel to each other, and said side walls and end walls are substantially perpendicular to each other and to said bottom wall when said packaging assembly is in an open, three dimensional, loading position.

3. A packaging assembly according to claim 2, wherein said side walls are integral with said bottom wall and said joints at said intersection of said side walls with said bottom wall are formed by folds, scores, perforations, or hinges.

4. A packaging assembly according to claim 3, wherein each end of each said side wall is integral with an adjacent said end portion and said joints at said intersection of said side walls with said adjacent end portions are formed by folds, scores, perforations, or hinges.

5. A packaging assembly according to claim 4, wherein adjacent said end portions comprising each said end wall are discontinuous and said joint at said intersection of said adjacent end portions is defined by a space.

6. A packaging assembly according to claim 5, wherein said protective liner is plastic coated paperboard.

7. A packaging assembly according to claim 6, wherein said flexible outer bag is heat sealable polymeric material.

8. A packaging assembly according to claim 7, wherein said heat sealable polymeric material is selected from the group consisting of polyethylene and polypropylene.

9. A packaging assembly according to claim 7 wherein said flexible outer bag comprises a continuous extruded tubular sheet sealed along one end to form a bottom of said bag.

10. A packaging assembly according to claim 1, wherein said protective liner is centrally positioned within said flexible outer bag whereby side extensions of said bag are formed extending beyond said liner ends.

11. A packaging assembly according to claim 10, wherein said side extensions of said flexible outer bag extend beyond each said end wall a distance corresponding to about 10 percent to about 50 percent the width of said end wall.

12. A packaging assembly according to claim 11, wherein said side extensions extend beyond each said end wall a distance corresponding to about 20 percent to about 30 percent the width of said end wall.

13. A packaging assembly according to claim 12, wherein said attachment of said flexible outer bag to said protective liner is continuous along said liner side and end walls and continues to seal said side extensions together.

14. A packaging assembly according to claim 1, wherein said flexible outer bag is additionally attached to said protective liner along a lower portion of said liner side walls and end walls.

15. A packaging assembly according to claim 1, wherein said outer bag is attached to said protective liner by adhesive.

16. A packaging assembly according to claim 1, wherein said outer bag is attached to said protective liner by sealing means.

17. A packaging assembly according to claim 16, wherein said sealing means is heat sealing.

18. A packaging assembly according to claim 17, wherein said flexible outer bag is heat sealed to said protective liner by means of a continuous seal.

19. A packaging assembly according to claim 1, additionally comprising a separate rigid or semi-rigid cover of a size to cover products packed in said protective liner and to fit entirely within said outer flexible bag.

20. A packaging assembly according to claim 1, wherein said protective liner comprises plastic coated paperboard.

21. A packaging assembly according to claim 1, wherein said flexible outer bag comprises heat sealable polymeric material.

22. In a packaging assembly for bulk meat products, the improvement comprising:

a protective liner constructed of rigid or semi-rigid, protrusion resistant material preventing protrusion of bones, having two side walls, a bottom wall, and two end walls, each said end wall comprising two end portions, said protective liner provided with joints along a central, longitudinal portion of said bottom wall, at an intersection of each said side wall with each said end wall, at an intersection of each said side wall with said bottom wall, and at an intersection of said end portions forming each of said end walls, said liner when folded upon itself along said joints forming a flat form with each said end portion extended outwardly from its adjacent side wall; and an outer bag of flexible sheet material closed for modified atmosphere packaging except for an open top and being wider than the length of said protective liner side wall plus two adjacent said end wall portions when folded flat, the inner surface of said bag attached to the outer surface of said liner along an upper portion of said side and end walls, said central bottom joint of said protective liner being located adjacent the bottom of said bag whereby said packaging assembly may be folded flat for storage and transport and converted to a substantially rectangular box closed on five sides by said liner providing side, end, and bottom walls when said outer bag is opened, and said open top of said bag extending beyond the top opening of said side and end walls of said liner.

* * * * *